US006735314B2

(12) United States Patent
Hoover

(10) Patent No.: US 6,735,314 B2
(45) Date of Patent: May 11, 2004

(54) EXPANDED STEREOPHONIC CIRCUIT WITH TONAL COMPENSATION

(75) Inventor: Alan Henderson Hoover, Indianapolis, IN (US)

(73) Assignee: Thomson Licensing S.A., Boulogne (FR)

( * ) Notice: Subject to any disclaimer, the term of this patent is extended or adjusted under 35 U.S.C. 154(b) by 166 days.

(21) Appl. No.: 10/144,495

(22) Filed: May 13, 2002

(65) Prior Publication Data

US 2003/0210792 A1 Nov. 13, 2003

(51) Int. Cl.[7] ..... H04R 5/00
(52) U.S. Cl. ..... 381/1; 381/17
(58) Field of Search ..... 381/1, 17, 18

(56) References Cited

U.S. PATENT DOCUMENTS 4,118,599 A * 10/1978 Iwahara et al. ..... 381/1
4,831,652 A * 5/1989 Anderson et al. ..... 381/1
5,692,050 A * 11/1997 Hawks ..... 381/1

* cited by examiner

*Primary Examiner*—Forester W. Isen
*Assistant Examiner*—Elizabeth McChesney
(74) *Attorney, Agent, or Firm*—Joseph S. Tripoli; Robert D. Shedd; Brian J. Cromarty

(57) ABSTRACT

A stereophonic processing system provided with spatial expansion of the stereophonic sound so that a pair of spaced-apart loudspeakers will acoustically appear to be spaced apart further then they actually are. The spatial expansion circuit includes tonal compensation.

12 Claims, 2 Drawing Sheets

EXPANDED STEREOPHONIC CIRCUIT WITH TONAL COMPENSATION

TECHNICAL FIELD

The present invention relates to a television receiver for receiving television program signals which include stereophonic sound signals, and more particularly, to the generation of a psycho-acoustic stereophonic expansion effect with tonal compensation so that it acoustically appears to the listener that the spatial separation of the loudspeakers is greater than the actual physical separation.

BACKGROUND

Spatial stereo expansion in audio systems and television receivers is well known and has been available for many years. In such systems, the left and right channel signals are processed in a manner so that it appears to the listener that the distance of separation of the loudspeakers is greater than the actual physical separation of the loudspeakers. This is called psycho-acoustic expansion. Examples of spatial stereo expansion are shown in U.S. Pat. No. 5,208,493 of Lendaro et al., U.S. Pat. No. 4,831,652 of Anderson, both assigned to the present assignee, and U.S. Pat. No. 4,495,637 of Bruney. In such spatial expansion systems, a portion of an inverted signal from the other channel is added to the signal of the subject channel such that an ambience of spaciousness is introduced between the left and right channels. This feature has the desirable characteristic of making the acoustic perceived stereo image appear to be wider than the actual location of a pair of stereophonic loudspeakers. This is particularly desirable for a television receiver or small radio, where the spacing between loudspeakers is typically only about 26–80 cm. apart.

The most effective stereo expansion schemes boost the midrange frequencies of the difference signal because their half-wavelengths are approximately the same length as the distance between the ears of humans. Sounds that originate from the left or right of the listener produce phase cancellation between the two ears if they are of the appropriate (midrange) frequencies. This is one of the main direction-determining clues that we receive for the location of the origination of a sound.

Expanded stereo systems basically do the same thing, e.g., amplifying the difference of the L and R stereo channels (L–R) relative to their sum signal (L+R). However, such expansion "drowns out" vocals which typically are sum signals, and tends to make dialog less intelligible. Additionally, expansion systems amplify the mid frequency band of the difference signal relative to the low and high audio frequencies. This adds a midrange coloration to the sound.

SUMMARY OF THE INVENTION

A stereophonic expansion circuit for L and R signal channels, wherein each of the L and R signal channels have respective first and second amplifiers with each amplifier having respective non-inverting and inverting input terminals and an output terminal. A signal is coupled to a respective non-inverting input terminal and a first feedback path is coupled between the respective output terminal and the respective inverting input terminal. A filter couples the inverting input terminals together for providing a psycho-acoustic expansion effect. Tonal compensation for the expanded signals is provided by a passive frequency compensating circuit coupled between the input terminals and the output terminals.

BRIEF DESCRIPTION OF THE DRAWINGS

Reference can be made to the drawings wherein.

DETAILED DESCRIPTION OF THE PREFERRED EMBODIMENT(S)

Figure 1:
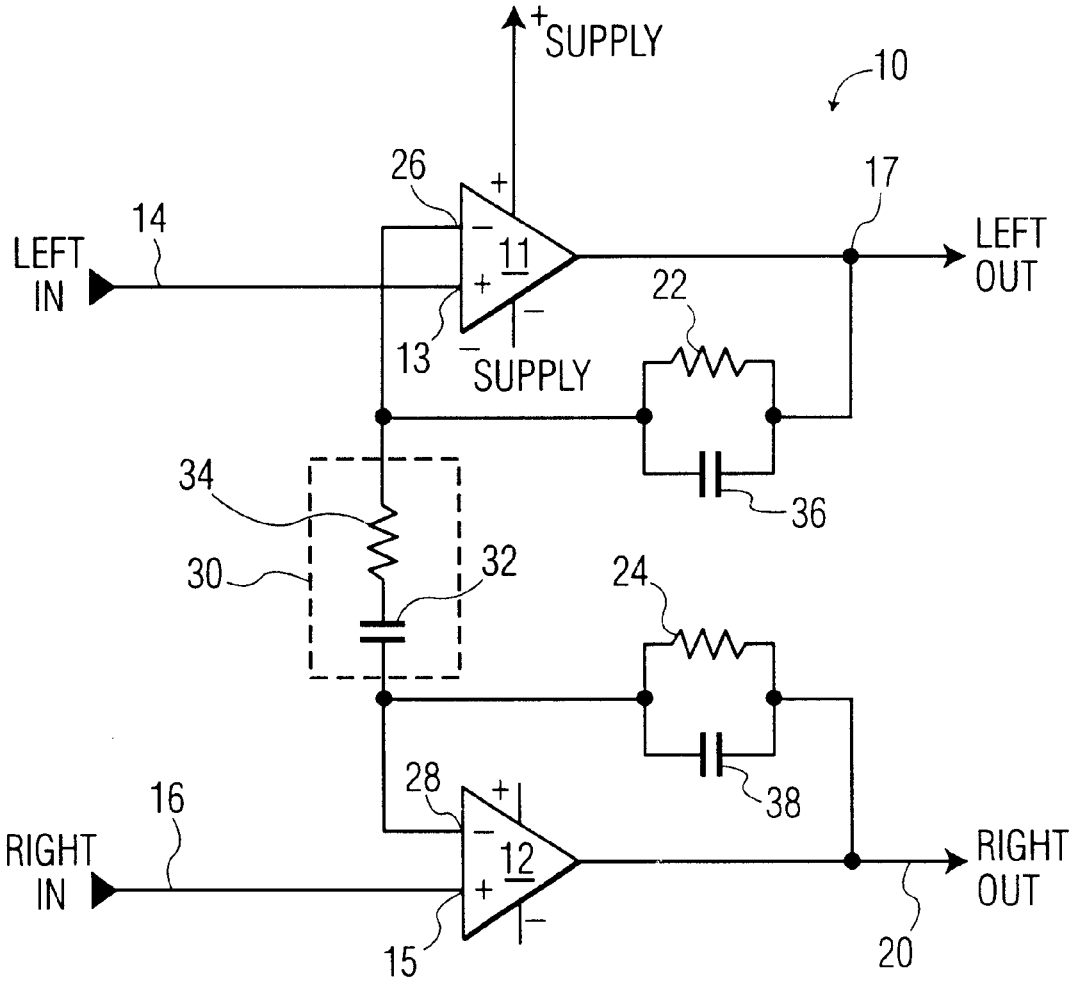
FIG. 1 PRIOR ART
FIG. 1 shows a stereophonic expansion circuit according to the prior art.

An exemplary prior art stereo expansion circuit is shown in FIG. 1, wherein stereo expansion circuit 10 includes two operational amplifiers (opamps) 11 and 12. A left (L) channel signal is applied to a positive (non-inverting) input terminal 13 of opamp 11 by way of an input line 14 and a right (R) channel signal is applied to a positive (non-inverting) input terminal 15 of opamp 12 by way of an input line 16. The right and left channel output signals at output lines 17, 20 are fed back by the respective resistors 22 and 24 to the respective inverting inputs 26, 28. A portion of the signals at inverting inputs 26, 28 are cross-coupled to each other via filter 30.

The cross-coupled signals cause each channel's output to effect the output of the other channel. Specifically, because of the cross-coupling, the output signal on the left output line 17 of opamp 11 is a L+X(L–R) signal while the output signal on the right output line 20 of opamp 12 is a R+X(R–L) signal, with the cross-coupling coefficient "X" being determined by the characteristics of the filter 30. The gain of this circuit often is between 0.5 and 2.0 with the gain being frequency dependent.

Filter 30 includes a capacitor 32 and a resistor 34. The values for capacitor 32 and resistor 34 are dependent upon the amount of the desired cross-coupling and the cross-over frequency of the cross-coupling. As the coupling coefficient X increases, the apparent separation of the loudspeakers increases. As the value of resistor 34 increases, the cross-coupling decreases because the signal current low into the feedback elements respectively connected to inverting inputs 26, 28 decreases. Capacitor 32, in combination with resistor 34, determines the cross-over frequency for the cross-coupling. The value of capacitor 32 typically is selected for little coupling at low frequencies with cross-coupling beginning as the signal frequency increases to about 150 Hz or 200 Hz, with full coupling achieved at about 1 KHz to 3 KHz.

Feedback capacitors 36, 38, in parallel with respective feedback resistors 22, 24, roll-off the frequency response of respective amplifiers 11 and 12 thus decreasing the cross-coupling between the channels through filter 30 above 5 KHz. The upper frequency break point for the respective exemplary channels is Fu=1/(2π(capacitor 36/38)(resistor 22/24)) and the lower frequency break point is Fl=1/(2π (capacitor 32)(resistor 34)). The effect of these break points is to provide a mid-frequency tonal boost.

Figure 2:
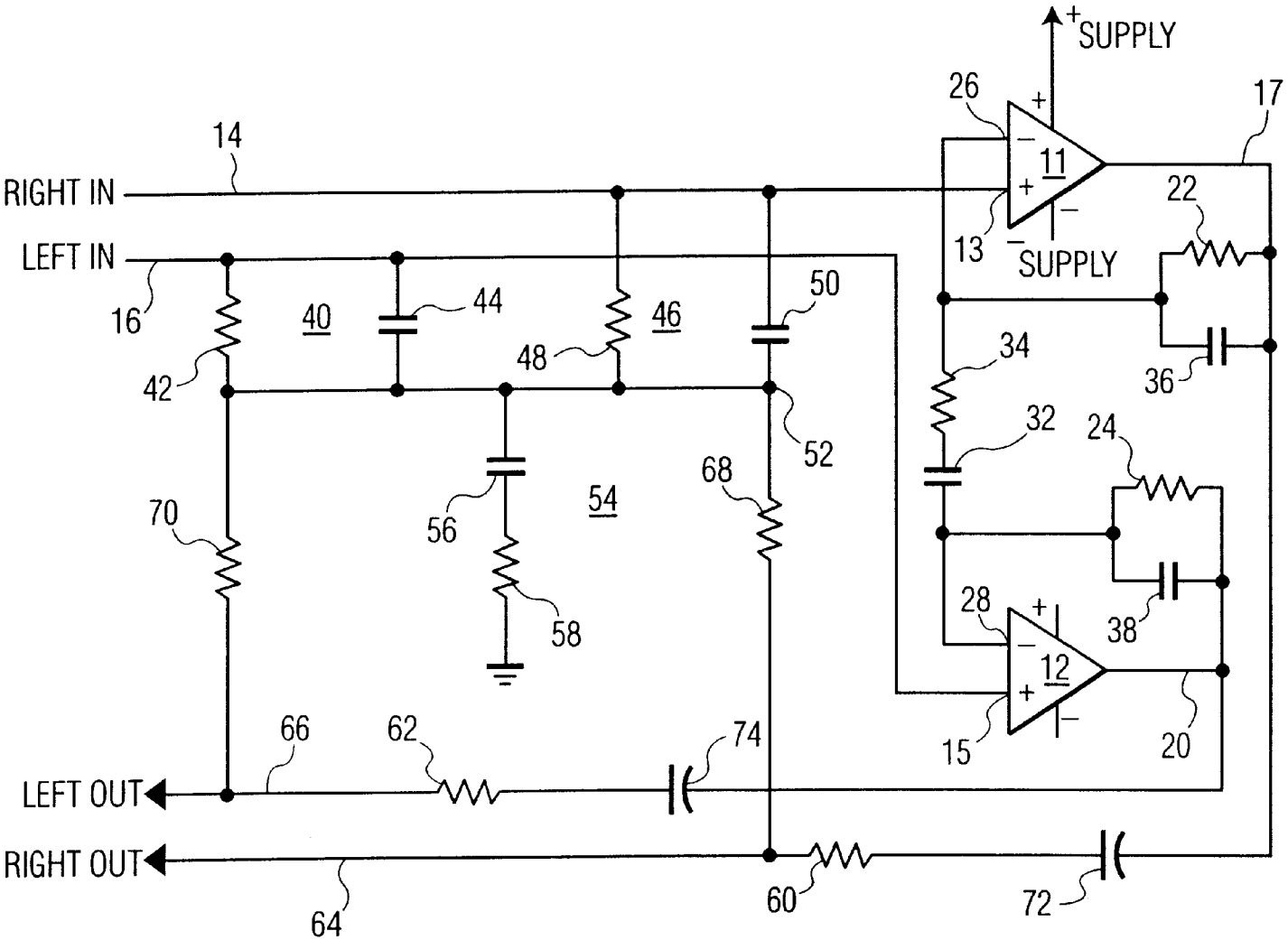
FIG. 2 shows a stereophonic expansion circuit with tonal compensation according to aspects of the present invention.

Members discussed above in connection with FIG. 1, are given identical numeral designations in FIG. 2 and in the interest of brevity, the discussion of these previously discussed members will not be repeated in connection with FIG. 2.

The signal input leads 14, 16 are each fed from a low impedance signal source (not shown), e.g., an opamp with unity feedback, such that the source impedance is essentially zero ohms. A parallel RC network 40, comprising a resistor 42 and capacitor 44, is connected to left input lead 16, and in a like manner, a parallel RC network 46, comprising a resistor 48 and capacitor 50, is connected to right signal input lead 14. Networks 40, 46 are connected to node 52 which forms a summing junction for the input signals, i.e., L+R. A series RC network 54, comprising capacitor 56 and resistor 58 connect node 52 to ground. L and R expanded signal output terminals 17, 20 are respectively coupled to resistors 60, 62 which are coupled to respective expanded signal output nodes 64, 66. Expanded signal output nodes 64, 66 are respectively coupled to summing node 52 by respective resistors 68, 70.

Networks 40, 46 are high pass filters with a turnover frequency, i.e., the signal frequency where the impedance of the capacitor equal the resistance of the resistor, of 3,600 Hz, and network 54 is a low pass filter with a turnover frequency of 340 Hz. Thus, the L+R sum signal at node 52 has a boosted bass and a boosted treble with respect to the midrange signal frequencies. This tonally compensated signal is then added to both of the left output signal at node 66 and the right output signal at node 64 by respective resistor dividers 70, 62, and 68, 60, since the output impedances of opamps 11, 12 are very low due to the large amount of feedback provided by respective resistors 22, 24. In this way, the tonally compensated sum signal with boosted treble and bass is added to the stereo expanded signals, which already has a boosted midrange, so that dialog or other center originated signals which would otherwise be directed to a center loudspeaker of a surround sound system, e.g., Dolby™ 5.1, would be more intelligible.

It should be noted that on a combined circuit basis, the various resistors and capacitors interact with each other. The system low frequency breakpoint is determined primarily by capacitor 56 and the parallel combination of resistors 42, 48 and 58 for a system low frequency breakpoint of approximately 115 Hz, with capacitors 44, 50 having a second order effect. The system high frequency breakpoint is primarily determined by the parallel combination of capacitors 44 and 50, in parallel with resistors 42, 48, with this combination being in series with resistor 58, for a high frequency breakpoint of approximately 5 KHz, with capacitor 56 having a second order effect.

In the exemplary embodiment, the component values are as follows: resistors 22, 24, 42, 48, are 20K; resistors 60, 62 are 30K, resistors 68, 70 are 47K, resistors 34, 58 are 10K; capacitors 44, 50 are 2.2 nf (nanofarad); capacitor 56 is 100 nf; capacitors 38, 38 are 4.7 nf, and capacitor 32 is 100 nf. Capacitors 72, 74 are coupling capacitors and are 1 microfarad.

Although the present tonal compensation is discussed in terms of two channels which are spatially expanded, the tonal compensation is also applicable to systems with more than two channels, e.g., a surround sound system. In a surround sound system, the rear loudspeakers are fed a difference signal, e.g., (L−R), (R−L) signals. The present tonal compensation can be applied irrespective of whether the rear loudspeaker signals are spatially expanded, or irrespective of whether they have a boosted mid-range with or without spatial expansion.

What is claimed is:

1. A stereophonic expansion circuit for L and R signal channels, comprising;

each of the L and R signal channels having respective first and second amplifiers, each amplifier having respective non-inverting and inverting input terminals and an output terminal, one of said respective input terminals of each amplifier receiving a respective input signal;

a feedback path coupled between the respective output terminal and the other of said respective input terminals not receiving an input signal;

circuit means for coupling signals between the other of said input terminals, for providing a psycho-acoustic expansion effect at the respective output terminals, and tonal compensation of the L and R expanded signals by a frequency dependent circuit coupled between the input terminals receiving an input signal and an output signal node coupled to the respective output terminals.

2. The stereophonic expansion circuit of claim 1 wherein the tonal compensation of the L and R signals is in the bass and/or treble frequency range.

3. The stereophonic expansion circuit of claim 1 wherein the L and R signals are tonally compensated with respect to mid-range frequency signals.

4. The stereophonic expansion circuit of claim 1 wherein the frequency compensating means comprise resistive and capacitive components.

5. The stereophonic expansion circuit of claim 4 wherein the resistive and capacitive components comprise at least one of a low pass filter and a high pass filter.

6. The stereophonic expansion circuit of claim 1 wherein the tonal compensation includes cross-coupling between the channels.

7. The stereophonic expansion circuit of claim 6 wherein the cross-coupling between channels includes forming an L+R signal node.

8. The stereophonic expansion circuit of claim 7 wherein the signal at the node is added to each of the expanded output signals.

9. The stereophonic expansion circuit of claim 8 wherein the addition of the L+R signal at the node to the expanded output signals is accomplished by a resistive divider.

10. A stereophonic expansion circuit for L and R signal channels, comprising;

each of the L and R signal channels having respective first and second amplifiers, each amplifier having respective non-inverting and inverting input terminals and an output terminal, one of said respective input terminals of each amplifier receiving a respective input signal;

a feedback path coupled between the respective output terminal and the other of said respective input terminals not receiving an input signal;

circuit means for coupling signals between the other of said input terminals, for providing a psycho-acoustic expansion effect at the respective output terminals, and tonal compensation of the L and R expanded signals by a frequency dependent circuit coupled between the input terminals receiving an input signal and an output signal node coupled to the respective output terminals, the tonal compensation including cross-coupling between the channels, the cross-coupling between channels including forming an L+R signal node, the signal at the L+R signal node being added to each of the expanded output signals.

11. A stereophonic expansion circuit for L and R signal channels, comprising;

each of the L and R signal channels having respective first and second amplifiers, each amplifier having respective non-inverting and inverting input terminals and an output terminal, one of said respective input terminals of each amplifier receiving a respective input signal;

a feedback path coupled between the respective output terminal and the other of said respective input terminals not receiving an input signal;

circuit means for coupling signals between the other of said input terminals, for providing a psycho-acoustic expansion effect at the respective output terminals, and tonal compensation of the L and R expanded signals by a frequency dependent circuit coupled between the input terminals receiving a signal and an output signal node coupled to the respective output terminals, the frequency compensating circuit comprising resistive and capacitive components, the resistive and capacitive components comprising at least one of a low pass filter and a high pass filter.

12. A circuit comprising;

at least a pair of signal channels having respective amplifiers, each channel having an amplifier, each amplifier having respective non-inverting and inverting input terminals, and an output terminal, one of said respective input terminals of each amplifier receiving a respective input signal;

a feedback path coupled between the respective output terminal and the other of said respective input terminals not receiving an input signal, and means for coupling a frequency dependent circuit between the at least two input terminals receiving a signal and between each of an at least two output signal nodes coupled to the respective output terminals.

* * * * *

UNITED STATES PATENT AND TRADEMARK OFFICE

CERTIFICATE OF CORRECTION

PATENT NO. : 6,735,314 B2
APPLICATION NO. : 10/144495
DATED : May 11, 2004
INVENTOR(S) : Alan Anderson Hoover It is certified that error appears in the above-identified patent and that said Letters Patent is hereby corrected as shown below:

Title page, item [75] Inventor's name reads "Alan Henderson Hoover" should read --Alan Anderson Hoover--.

Signed and Sealed this

Second Day of December, 2008

JON W. DUDAS
*Director of the United States Patent and Trademark Office*